US005423731A

United States Patent [19]

Chen

[11] Patent Number: 5,423,731

[45] Date of Patent: Jun. 13, 1995

[54] EXERCISE DEVICE WITH TWO SEATS

[76] Inventor: David Chen, 5F1, No. 412-12, 2 Sec., Chung Shan Rd., Tai Peiping, Taichung, Taiwan, Prov. of China

[21] Appl. No.: 253,310

[22] Filed: Jun. 3, 1994

[51] Int. Cl.[6] ..... A63B 21/04

[52] U.S. Cl. ..... 482/130; 482/72; 482/96; 482/133

[58] Field of Search ..... 472/108, 112, 124, 125, 472/120, 135; 482/51, 57, 62, 72, 95, 96, 123, 129, 130, 133

[56] References Cited

U.S. PATENT DOCUMENTS

| | | | |
|---|---|---|---|
| 2,699,201 | 1/1955 | Levy | 472/125 |
| 3,380,737 | 4/1968 | Elia et al. | 482/72 |
| 4,582,320 | 4/1986 | Shaw | 482/130 |
| 4,919,416 | 4/1990 | DeCloux | 482/57 |

*Primary Examiner*—Richard J. Apley

*Assistant Examiner*—Lynne A. Reichard

[57] ABSTRACT

An exercise device with two seats comprises a base body, an upstanding post, a resilient member, a pair of cantilever beams, and a linkage connected between each of the two cantilever beams and the upstanding post. The base body of a triangular configuration comprises a horizontal rod with a cross piece at each end thereof. The horizontal rod and the cross pieces are adapted to be supported on a ground surface. The upstanding post is pivotally mounted at an apex of the base body. The upstanding post has a handlebar mounted at the upper end thereof and a leg rest mounted at the lower end thereof. The resilient member is connected between the lower end of the upstanding post and the pivoting portion of the horizontal rod and is capable of extending when an external force is applied to the upstanding post. The two cantilever beams are provided respectively with a cushioned seat mounted thereon.

4 Claims, 3 Drawing Sheets

EXERCISE DEVICE WITH TWO SEATS

BACKGROUND OF THE INVENTION

This invention relates to a sporting equipment, and more particularly, to an exercise device with two seats.

Practicing an exercise through a sporting equipment has become more and more popular in our modern life. On the other hand, it is easy for everyone to find a suitable place or park for doing an exercise. There are some sporting houses which are installed with many sporting houses which are installed with many sporting equipments for indoor sports, but not everyone can afford it.

In light of this, some sporting equipments for indoor or home use are available in the market. These sporting equipments are very popular now days. But these sporting equipments are designed for only one person because they have only one seat. It is easy for a person to feel lonely and bored when the person is doing an exercise alone. Besides, in most cases, each family can afford only one sporting equipment because of space limitation. As a result, it is very difficult to invite another member of a family to do the same exercise. In addition, each sporting equipment of the prior art has only one designated function.

SUMMARY OF THE INVENTION

It is the object of this invention to provide an exercise device with two seats suitable for two people to do an exercise simultaneously. Accordingly, a couple or two members of a family can do the same exercise simultaneously with the exercise device of the present invention.

In order to achieve the object set forth, the exercise device with two seats includes a base body which is constructed with rigid rods to form a triangular configuration. The horizontal rods of the base body rest against the ground.

An upstanding post is pivotally mounted at the apex of the base body. A handlebar is provided at each of both ends of the upstanding post. A leg rest is provided at the lower portion of the upstanding post.

A resilient means is disposed between the lower portion of the handlebar and the horizontal rod of the base body. The resilient means is capable of being extended when an external force is applied thereon.

A pair of seats are supported by a cantilever beam pivoted to both sides of the base body. The seats are provided with a cushion for easy seating.

A linkage is connected between the cantilever beam and the upstanding post.

By this arrangement, two people can do the same exercise simultaneously. During the exercise, one can move forward while the other can move backward.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of an exercise device with two seats. In the drawings.

DETAILED DESCRIPTION OF THE EMBODIMENT

Figure 1:
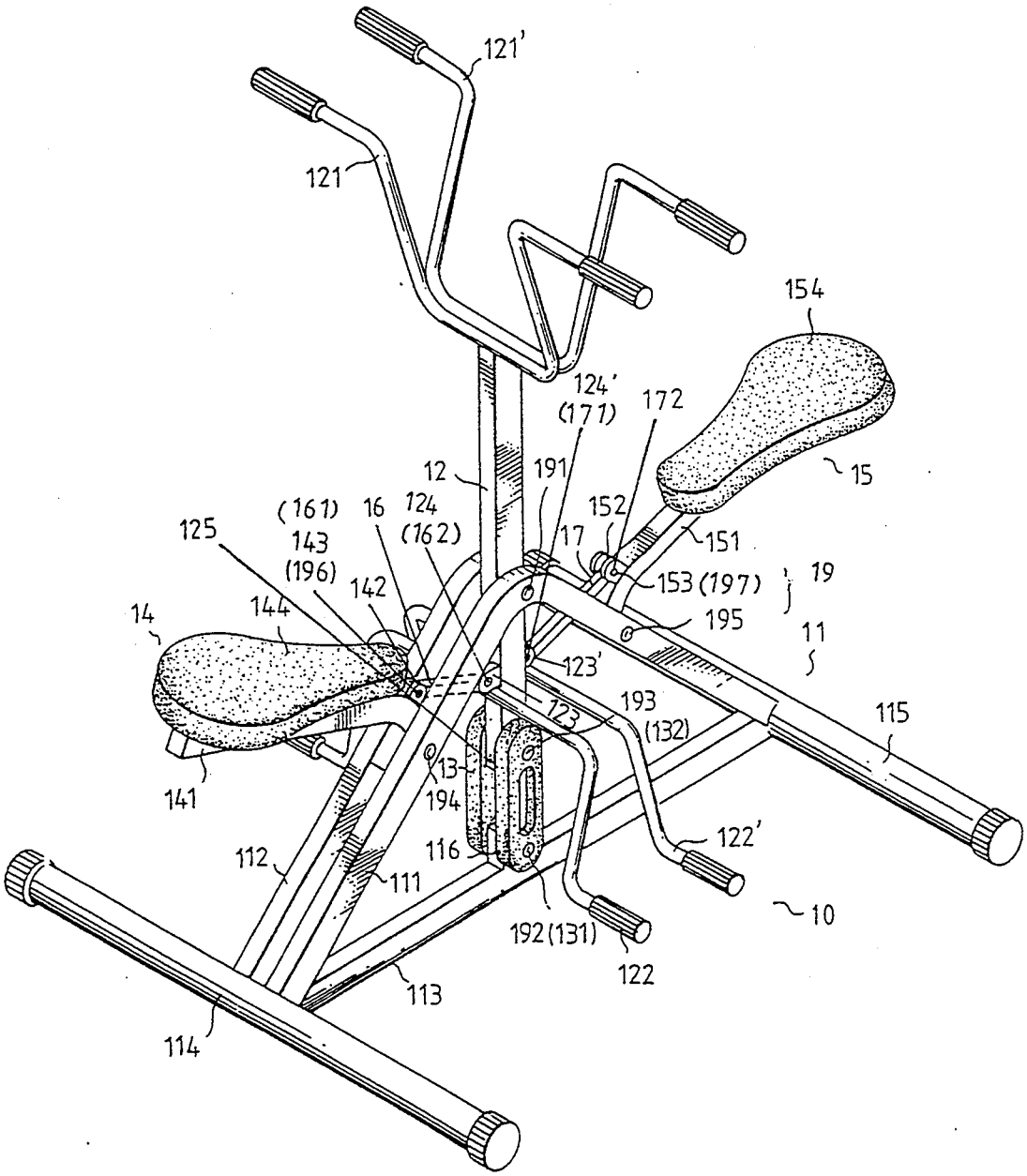
FIG. 1 is a perspective view of the exercise device made according to this invention.

Referring to FIG. 1, an exercise device 10 of this invention includes a base body 11, an upstanding post 12, a resilient means 13, a pair of seats 14, 15, a pair of linkages 16, 17 and a connection element 19.

The base body 11 is made up of a pair of leg portions 111, 112 and a horizontal rod 113 connected to the leg portions 111, 112. The leg portions 111, 112 are spaced by a predetermined distance and are parallel to each other. A pair of cross pieces 114, 115 are connected to the ends of the horizontal rod 113. The middle portion of the horizontal rod 113 is provided with a pivoting portion 116.

The upstanding post 12 is mounted pivotally by means of the connection element 191 to the apex of the base body 11. The upstanding post 12 can be caused to swing back and forth. By this arrangement, the upstanding post 12 can be moved forward and backward. A pair of handlebars 121, 121' are mounted at the upper end of the upstanding post 12. Besides, a pair of leg rests 122, 122' are mounted at the lower portion of the upstanding post 12. By this arrangement, the upstanding post 12 can sustain the weight of an exerciser through the provision of the leg rests 122, 122' and the handlebars 121, 121'. The upper portion of the leg rests 122, 122' are provided respectively with U-shaped lugs 123, 123' having respectively holes 124, 124'. The lower end of the upstanding post 12 is provided with a connecting portion 125.

The resilient means 13 of a rubber material is connected between the connecting portion 125 of the upstanding post 12 and the pivoting portion 116 of the horizontal rod 113 of the base body 13 by means of the first connecting elements 192, 193 which are engageable with the connecting hole of the pivoting portion 116 and the connecting hole of the connecting portion 125 of the upstanding post 12. The resilient means 13 is provided with holes 131, 132 which are located respectively at both ends thereof. The connecting elements 192, 193 are positioned by a pair of first C-clips respectively. By this arrangement, the movement of the upstanding post 12 is limited by the resilient means 13.

The seats 14, 15 are fastened to the leg portions 111, 112 through a pair of cantilever beams 141, 151 by means of the connecting elements 194, 195. The cantilever beams 141, 151 are provided respectively with U-shaped lugs 142, 152 which have respectively holes 143, 153. The seats 14, 15 are provided respectively with cushions 144, 145 for comfortable seating.

The linkages 16, 17 are connected between the cantilever beams 14, 165 and the U-shaped lugs 123, 123' of the upstanding post 12. The linkages 16, 17 are provided respectively with holes 161, 162, 171 and 172. The second connecting elements 196, 197 are engageable with the holes 161, 162, 171 and 172 of the linkages 16, 17 and with the holes 143, 153 of the seats 14, 16 and further with the holes 124, 124' of the upstanding post 12. A second C-clip is used to locate the second connecting elements 196 and 197 respectively.

Figure 2:
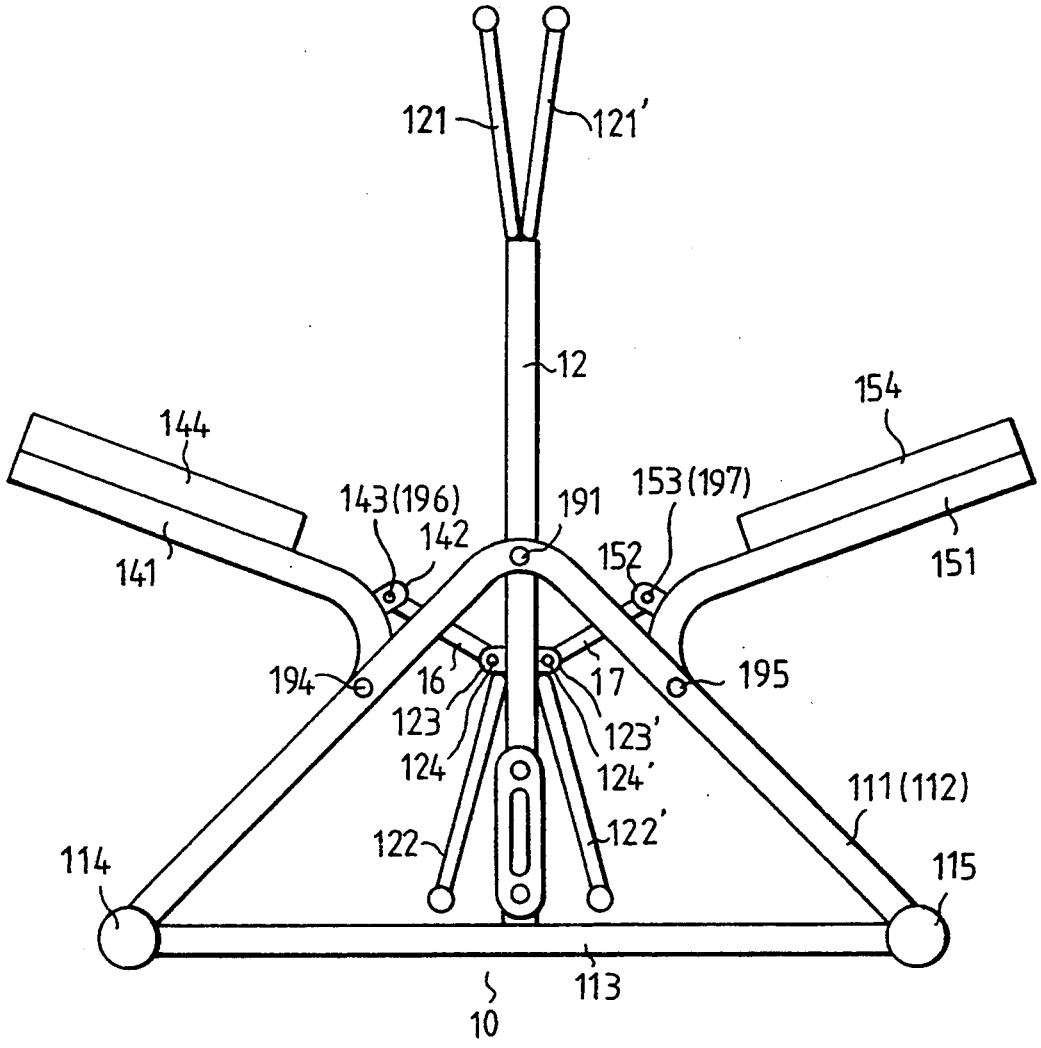
FIG. 2 is a side plan view of the exercise device made according to this invention.
Figure 3:
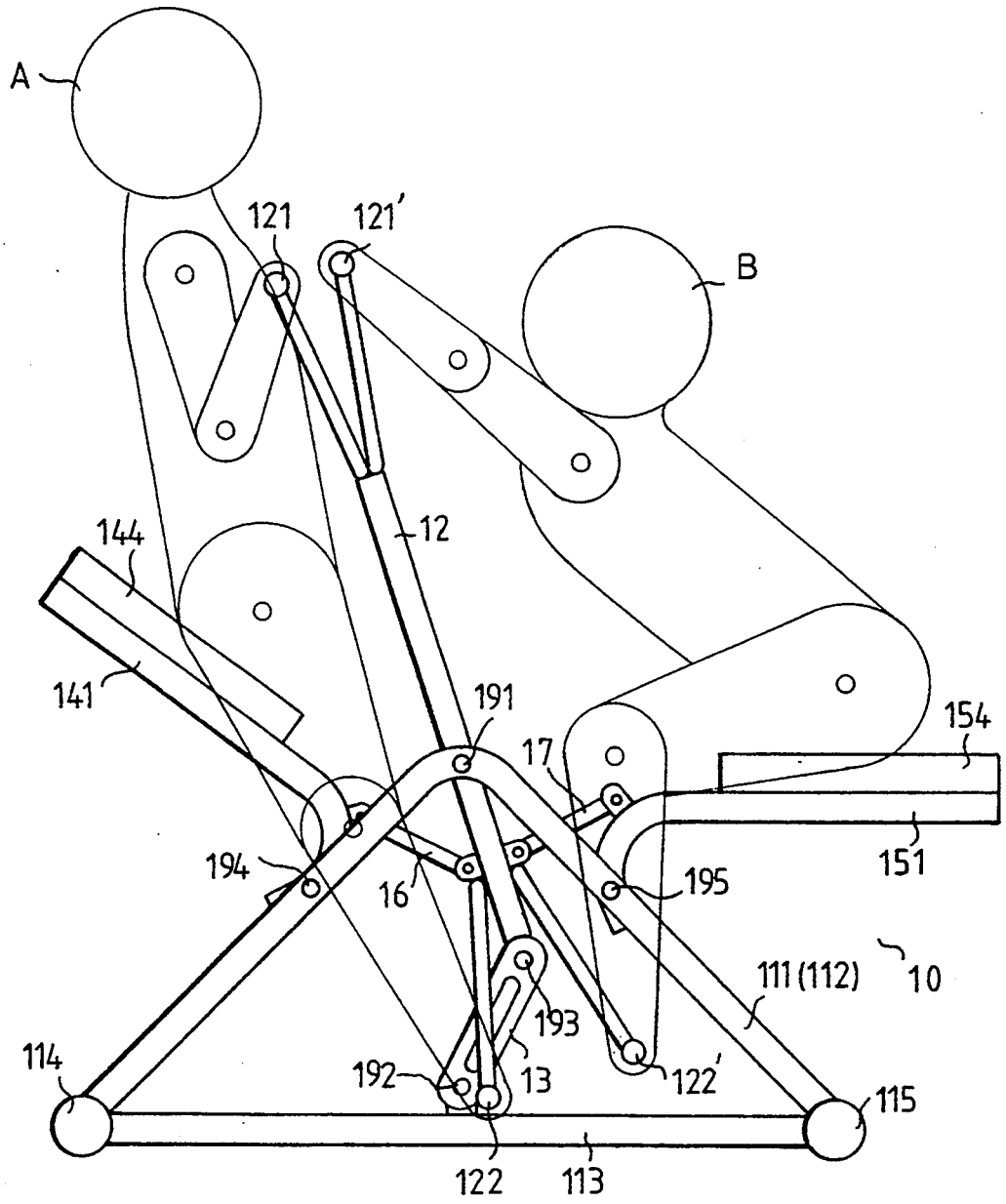
FIG. 3 is a schematic view showing the action of the exercise device made according to this invention.

By the assembly of the above described elements, the exercise device 10 with two seats is accomplished. As shown in FIGS. 2 and 3, the upstanding post 12 is positioned at the vertical position of the base body 11 when not in use. On the other hand, the restoring force of the resilient means 13 connected between the horizontal rod 113 and the lower end of the upstanding post 12 also causes the upstanding post 12 to rest in a vertical position. Accordingly, the seats 14, 15 are tested in an angular position and the linkages 16, 17 are rested in a horizontal position. When exercisers are seated on the seats 14, 15, the handlebars 121, 121' and the leg rests 122, 122' are also ready for supporting the hands and the legs of the exercisers respectively.

As shown in FIG. 3, when a person who is designated as A and seated on the left side of the Figure pushes forward the leg rest 122 of the upstanding post 12, the handlebar 121 is moved backwards. In the meantime, the upper portion of the resilient means 13 is moved rightwards. When the linkage 17 is moved leftwards and the lower portion of the upstanding post 12 is moved leftwards, the seat 15 is moved downward to remain in a horizontal position, as shown in FIG. 3. The arms of the person A are retracted and the feet of the person A are extended while the arms of the person B are stretched and the feet of the person B are retracted. On the other hand, the waist of the person B is also bent forward. When the person B pulls back his or her hands and stretches his or her feet, the postures of the two persons change completely, meaning that the hands of the person A are stretched while his or her feet are retracted and that the hands of the person B are retracted while his or her feet are stretched. By this arrangement, both persons can stretch his or her hands and feet alternately.

During the exercise, as shown in FIG. 3, the person A sustains the weight of the person B when the hands of the person A are retracted and the feet of the person A are stretched. As a result, both persons can get an excellent exercise from this exercise device of the present invention.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

What is claimed is:

1. An exercise device with two seats comprising:

a base body comprising a horizontal rod with a cross piece at each end thereof, said horizontal rod and said cross pieces adapted to be supported on a ground surface and a generally triangular portion comprising two leg portions mounted on said horizontal rod in a spaced relationship which are angled towards each other and joined above said horizontal rod to form an apex;

an upstanding post pivotally mounted at said apex to said base body, said upstanding post having a handlebar mounted at the upper end of the upstanding post and having a leg rest mounted at the lower end of the upstanding post;

a resilient means connected between said lower end of said upstanding post and said horizontal rod at a pivoting portion thereon, said resilient means being capable of extending when an external force is applied to the upstanding post;

a pair of cantilever beams each having a first end and a second end disposed on opposite sides of said base body, one cantilever beam pivotally mounted at said first end to one of said leg portions of said base body and the other cantilever beam pivotally mounted at said first end to the other of said leg portions of said base body, said pair of cantilever beams each having a cushioned seat mounted on said second end; and a linkage connected between each of said pair of cantilever beams and said upstanding post.

2. The exercise device of claim 1, wherein said resilient means is a rubber spring having a hole at each end connected between said pivoting portion of said horizontal rod and a lug on the lower end of said upstanding post.

3. The exercise device of claim 2, further comprising a pair of first connecting elements and first C-clips for locking said rubber spring to said upstanding post and said horizontal rod of said base body, respectively.

4. The exercise device of claim 1, wherein said upstanding post further comprises a first pair of U-shaped lugs disposed on opposite sides thereof and each of said cantilever beams comprises a U-shaped lug at the first end thereof, each of the U-shaped lugs comprising a second connecting element and a second C-clip for locking said linkage to said upstanding post and each of said cantilever beams.

* * * * *